United States Patent [19]

Bronson

[11] Patent Number: 4,880,068

[45] Date of Patent: Nov. 14, 1989

[54] ROTARY DRILL BIT LOCKING MECHANISM

[75] Inventor: Charles L. Bronson, Brownsville, Tex.

[73] Assignee: Varel Manufacturing Company, Dallas, Tex.

[21] Appl. No.: 273,554

[22] Filed: Nov. 21, 1988

[51] Int. Cl.[4] ..... E21B 10/22

[52] U.S. Cl. ..... 175/369; 384/96

[58] Field of Search ..... 175/367, 368, 369, 371, 175/372; 384/96; 285/321

[56] References Cited

U.S. PATENT DOCUMENTS

| | | | |
|---|---|---|---|
| 930,759 | 8/1909 | Hughes . | |
| 959,540 | 5/1910 | Hughes . | |
| 1,816,203 | 7/1931 | Behnke . | |
| 1,947,586 | 2/1934 | Fletcher . | |
| 2,065,740 | 12/1936 | Reed | 384/96 |
| 2,065,742 | 12/1936 | Reed . | |
| 2,147,926 | 2/1936 | Scott . | |
| 2,192,697 | 3/1940 | Scott | 384/96 |
| 2,620,686 | 12/1952 | Peter . | |
| 2,654,577 | 10/1953 | Green . | |
| 2,661,932 | 12/1953 | Woods . | |
| 2,797,067 | 6/1957 | Fisher | 384/96 |
| 2,814,465 | 11/1957 | Green . | |
| 3,144,087 | 8/1964 | Williams, Jr. . | |
| 3,656,764 | 4/1972 | Robinson . | |
| 3,721,307 | 3/1973 | Mayo . | |
| 3,746,405 | 7/1973 | Welton . | |
| 3,844,363 | 10/1974 | Williams, Jr. . | |
| 3,845,994 | 11/1974 | Trey . | |
| 4,111,464 | 9/1978 | Asano et al. | 285/321 X |
| 4,111,530 | 9/1978 | Fuehrer et al. | 285/321 X |
| 4,373,752 | 2/1983 | Nelson | 285/321 X |
| 4,506,997 | 3/1985 | Schramm et al. | 175/369 X |
| 4,511,008 | 4/1985 | Brunson | 384/96 X |
| 4,600,064 | 7/1986 | Scales et al. | 175/369 X |

FOREIGN PATENT DOCUMENTS

| | | | |
|---|---|---|---|
| 1361289 | 12/1987 | U.S.S.R. | 175/369 |
| 338146 | 11/1930 | United Kingdom | 175/369 |

*Primary Examiner*—William P. Neuder

*Attorney, Agent, or Firm*—Harold E. Meier

[57] ABSTRACT

The present invention is a rotary drill bit locking mechanism comprising a support spindle and a cutter cone with bearing surfaces. Furthermore, first and second annular grooves are formed on the bearing surfaces of the support spindle and the cutter cone that are radially adjacent to each other when the cutter cone is secured onto the support spindle. Additionally, a holding ring having a plurality of segments is assembled into the first and second annular grooves to secure the cutter cone into a rotatable position on the support spindle. Further, there is means for biasing the segments of the holding ring into a ring-like configuration in the annular grooves. This invention thus provides a rotary drill bit locking mechanism for holding a cutter cone onto the support spindle that is easy to manufacture and assemble.

8 Claims, 2 Drawing Sheets

ROTARY DRILL BIT LOCKING MECHANISM

TECHNICAL FIELD

This invention relates to locking mechanisms for rotary drill bits having a support spindle and a cutter cone, and more particularly, to a locking mechanism for securing the cutter cone onto the support spindle of the rotary drill bit.

BACKGROUND OF THE INVENTION

Various means have been utilized in the past to secure the cutter cone to the support spindle or journal of a rotary drill bit. Prior devices have included utilization of a series of bearing balls inserted into complementary grooves of the drill bit cutter cone and support spindle during assembly.

For many years, one method of attachment has been that disclosed by U.S. Pat. Nos. 930,757 and 959,540, whereby a row of bearing balls running in semicircular grooves mate the cutter cone to the support spindle or journal of the rotary drill bit. In recent years, attempts have been made to use snap rings of various configurations, but without any permanent success.

The locking mechanism of the prior art for securing the cutter cone to the support spindle, however, involves complexities in manufacture and assembly, especially where a large number of bearing balls is involved. Such prior attempts to mate the support spindle and cutter cone also require a means to combine them into an operating position.

Other attempts to secure the cutter cone onto the support spindle have included single expansible elements in the form of a ring seated for permanent axial placement of the cutter cone on the support spindle as disclosed by U.S. Pat. No. 3,746,405.

According to the present invention, the cutter cone is secured to the support spindle or journal of the rotary drill bit by using a segmental holding ring and an elastomer O-ring combination that is free to rotate in annular grooves in the bearing surfaces of the support spindle and cutter cone. The design of the mating grooves is such that there is enough radial clearance so that the segmental holding ring and elastomer O-ring combination is free to rotate. Thus, the present invention simplifies many of the complicated machining steps used in manufacturing the locking and mating mechanisms of the Prior art in that it eliminates the use of ball bearings, and is easily manufactured and assembled.

SUMMARY OF THE INVENTION

The present invention relates to an apparatus for securing a cutter cone of a rotary drill bit onto the support spindle or journal by the use of bearing means for securing the cutter cone onto the support spindle.

In the preferred embodiment of the invention, the mating is accomplished via a segmental holding ring and an elastomer O-ring combination that is free to rotate in annular grooves formed in the bearing surfaces of the cutter cone and the support spindle. The grooves in the cutter cone and support spindle match the configuration of the segmental holding ring, allowing only enough clearance so that the segmental holding ring is free to rotate. The depth of the groove in the support spindle is machined so that substantially one-half of the radial thickness of the segmental holding ring will be accommodated by the annular groove in the support spindle. The other half of the segmental holding ring is accommodated by the annular groove in the cutter cone.

BRIEF DESCRIPTION

A more complete understanding of the invention may be had by reference to the following Detailed Description when taken in conjunction with the accompanying drawings, wherein.

DETAILED DESCRIPTION

Figure 1:
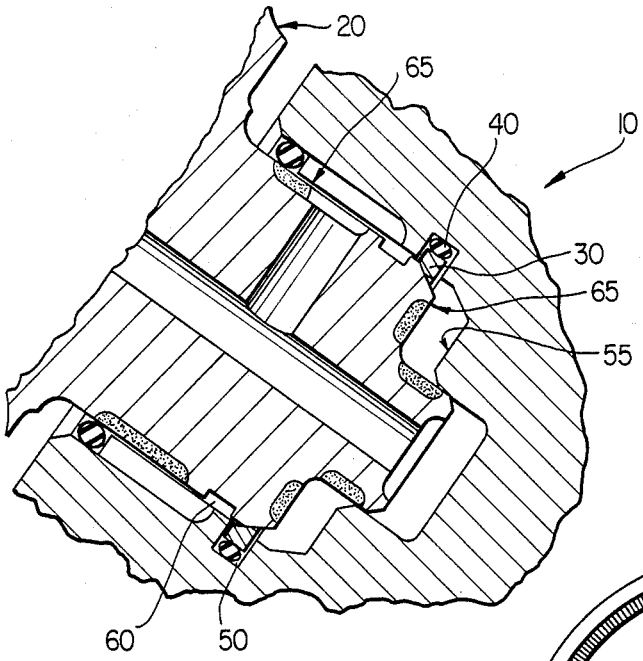
FIG. 1 is a cross-sectional view of a locking mechanism for a rotary drill bit before securing of the cutter cone to the support spindle.

Referring now to FIG. 1, therein is shown a cutter cone 10 before it is secured to a support spindle or journal 20 by means of a segmental holding ring 30 and elastomer O-ring 40 combination that is free to rotate in annular grooves 50 and 60 in the bearing surfaces 55 and 65 of the cutter cone 10 and support spindle 20, respectively.

The bearing surface 55 of the cutter cone 10 and bearing surface 65 of the spindle 20 are made of any conventional bearing material, including hard surfaced steel or the like. The annular groove 50 is formed in the bearing surface 55 of the cutter cone 10. The annular groove 60 is formed in the bearing surface 65 of the spindle 20.

The annular grooves 50 and 60 (more fully revealed in FIG. 4) in the cutter cone 10 and support spindle 20 are of the same configuration as the segmental holding ring 30. There is enough clearance, however, so that the segmental holding ring 30 and elastomer O-ring 40 combination is free to rotate after the cutter cone 10 is secured onto the support spindle 20.

The depth of the annular groove 60 in the support spindle 20 is machined to a predetermined specification so that only substantially one-half of the radial thickness of the segmental holding ring 30 will be accommodated by the annular groove 60 in the support spindle 20. Similarly, substantially one-half of the radial thickness of the segmental holding ring 30 is accommodated by the annular groove 50 in the cutter cone 10. The annular groove 50 is machined in order to accommodate the outer portion of the segmental holding ring 30 in conjunction with the elastomer O-ring 40.

By designing and machining the two annular grooves 50 and 60 such that there is just enough radial clearance, the segmental holding ring 30 and elastomer O-ring 40 combination is free to rotate after the cutter cone 10 is attached to the support spindle 20.

The material and hardness of the segmental holding ring 30 is such that there is little, if any, galling and very little wear between the mating surfaces of the cutter cone 10 and the support spindle 20 and the bearing surfaces of the annular grooves 50 and 60 in connection with the rotating segmental holding ring 30.

Although any material having the requisite hardness may be used, in the preferred embodiment of the invention, the material of the segmental holding ring 30 is beryllium copper. The elastomer O-ring 40 is also composed of a material having the requisite hardness to resist any tendency to force the elastomer O-ring 40 into a rectangular cross-section at anytime except during assembly.

Figure 2:
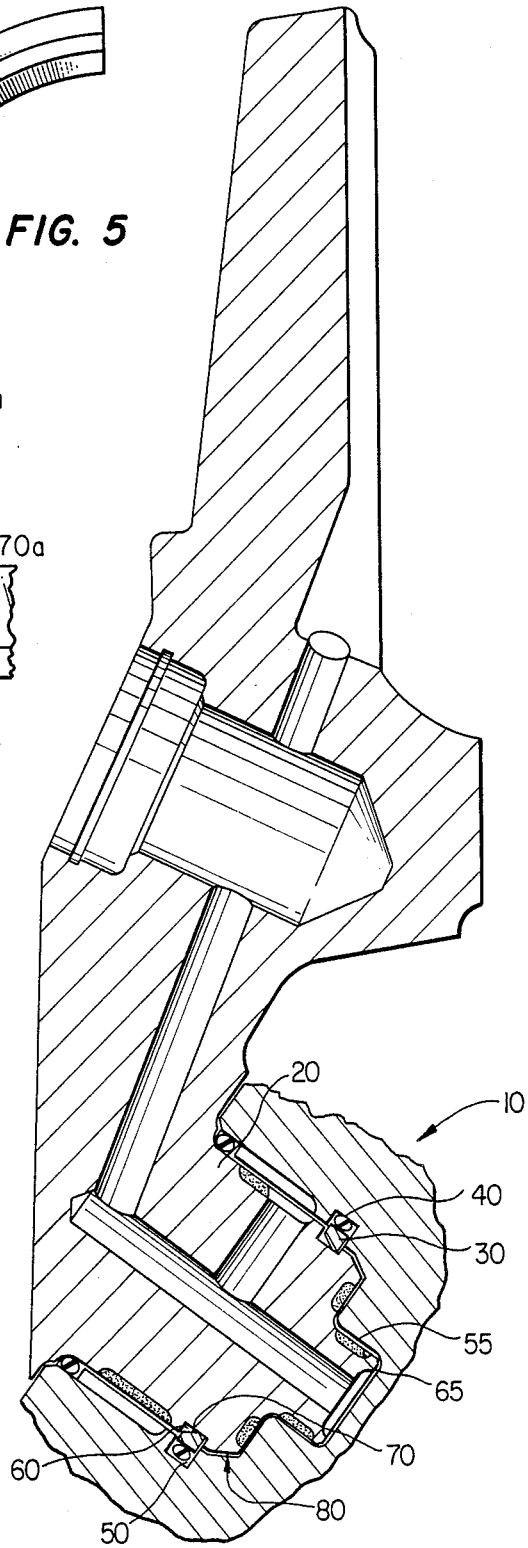
FIG. 2 is a cross-sectional view of the locking mechanism of the rotary drill bit with the cutter cone secured in place onto the support spindle.

Turning now to FIG. 2, therein is further shown the juxtaposition and alignment of the segmental holding ring 30 and elastomer O-ring 40 combination after the cutter cone 10 has been secured to the support spindle 20.

In the preferred embodiment of the invention, the elastomer O-ring 40 is external to the segmental holding ring 30. The annular grooves 50 and 60 of the cutter cone 10 and support spindle 20 are aligned, but leave enough space so that the elastomer O-ring 40 and segmental holding ring 30 combination may freely rotate.

The invention is not, however, restricted to having the elastomer O-ring 40 external to the segmental holding ring 30 in the cutter cone 10. The elastomer O-ring 40 may be internal to the segmental holding ring 30 and located in the groove 60 of the support spindle 20. Due to the ease of assembly and manufacturing, however, the elastomer O-ring 40 in the preferred embodiment of the invention is external to the segmental holding ring 30.

Figure 4:
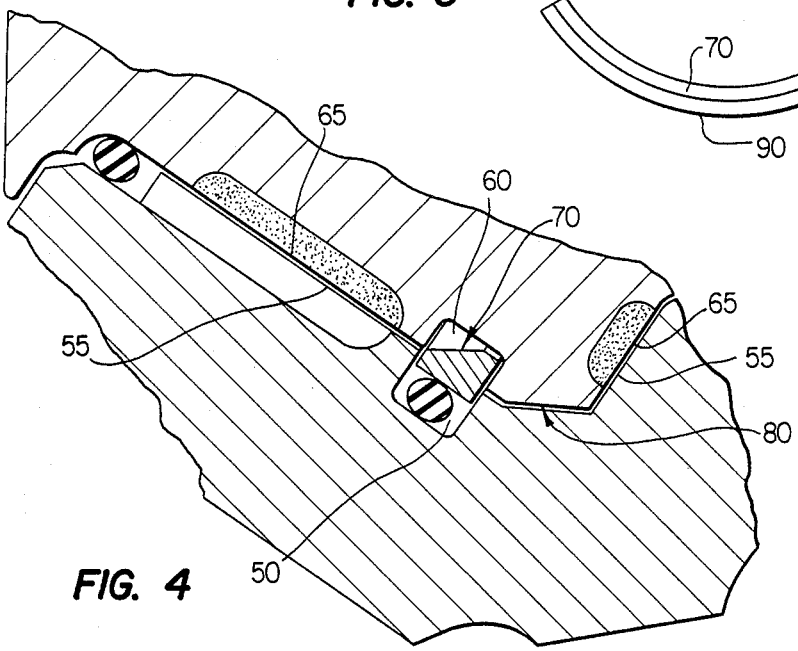
FIG. 4 is an enlarged cross-sectional view showing the preferred embodiment of the locking mechanism of the rotary drill bit used to secure the cutter cone to the support spindle.

Although shown in FIGS. 1 and 2, FIG. 4 more fully discloses another feature of the invention relating to the ease of assembly, but one that is not necessary for the locking action of the segmental holding ring 30 and elastomer O-ring 40 combination. This involves a taper 70 on the inner diameter of the segmental holding ring 30 that matches a taper on the thrust face surface 80 of the support spindle 20.

As disclosed in FIGS. 1 and 2, to secure the cutter cone 10 to the support spindle 20, the elastomer O-ring 40 is placed in the groove 50 of the cutter cone 10 and the segmental holding ring 30 is placed inside the remaining groove space and held in place with a lubricant. In the preferred embodiment of the invention, this lubricant is grease.

The support spindle 20 is then placed inside the cutter cone 10 until the taper thrust surface 80 of the of the support spindle 20 engages the taper 70 of the segmental holding ring 30 (FIG. 1). At this time, the cutter cone 10 and support spindle 20 are forced or pressed together.

Figure 3:
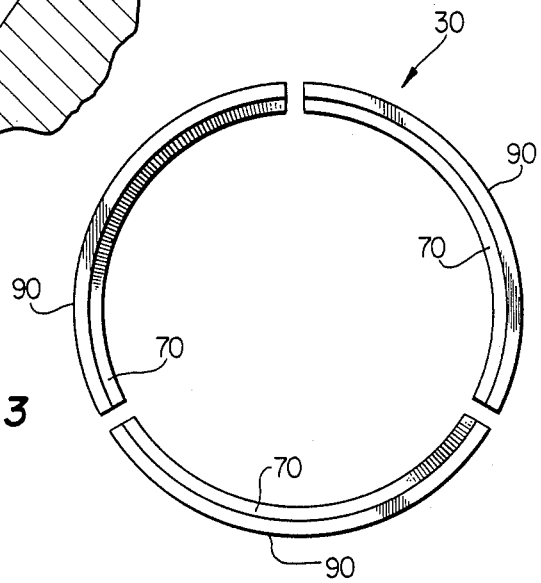
FIG. 3 is a plan view showing one embodiment of the segmental holding ring.

As the cutter cone 10 and support spindle 20 are Pressed together, the segments 90 (FIG. 3) of the segmental holding ring 30 are forced radially outward, compressing the elastomer O-ring 40. As the elastomer O-ring 40 becomes fully compressed to a rectangular cross-section, the segments 90 of the segmental holding ring 30 engage the rectangular groove 50 in the cutter cone 10 and snap inward into the groove 60 in the support spindle 20. At this point, the cutter cone 10 has fully engaged the support spindle 20 and the segmental holding ring 30 and elastomer O-ring 40 combination locks the cutter cone 10 to the support spindle 20 (FIG. 2).

Although the taper 70 on the segments 90 of the segmental holding ring 30 is not necessary in order to mate the support spindle 20 with the cutter cone 10, it is the preferred embodiment from the standpoint of ease of assembly. Any number of segments 90 may be used in the segmental holding ring 30, however, in the preferred embodiment of the invention, there are three segments 90.

Additionally, the axial and radial clearances between the segmental holding ring 30 and the annular grooves 50 and 60 in the cutter cone 10 and support spindle 20 may be of any predetermined size and clearance that allows the segmental holding ring 30 and elastomer O-ring 40 combination to freely rotate while locking the cutter cone 10 onto the support spindle 20. In the preferred embodiment of the invention, this clearance is approximately five thousandths (0.005) of an inch.

Figure 5:
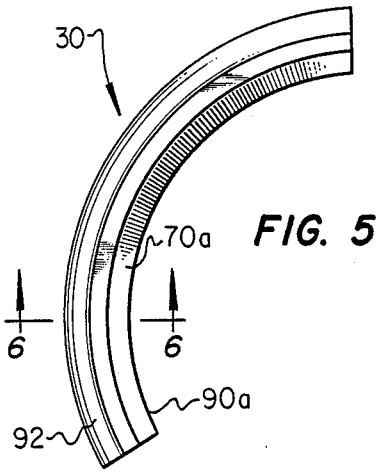
FIG. 5 is a side view of one segment of an alternate embodiment of the segmental holding ring as illustrated in FIG. 3.
Figure 6:
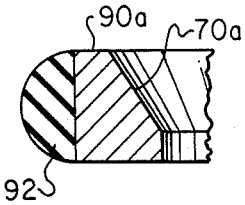
FIG. 6 is a sectional view of the segment of FIG. 5 taken along the line 6—6.

Referring now to FIGS. 5 and 6, there is shown an alternate embodiment of the segmental holding ring 30 and specifically there is shown a segment **90*a* having affixed thereto an elastomeric segment 92. In the embodiment illustrated in FIGS. 5 and 6, the segment 90*a* has essentially the same configuration as the segments 90 of FIG. 3. As such, the segment 90*a* includes a taper 70*a* as best illustrated in FIG. 4. The elastomeric ring 92 is made from the same compressible material as the O-ring 40 of the embodiment of the invention shown in FIGS. 1–4**.

With reference to the embodiment of the segmental holding ring as illustrated in FIGS. 5 and 6, three of the segments **90*a* comprise the total segmental holding ring and function to lock the cutter cone 10 unto the support spindle 20 as was described with reference to the embodiment of FIGS. 1–4. In the alternate embodiment shown in FIGS. 5 and 6, after assembly of the three segments 90*a* into the groove 50 and the assembly of the cutter cone 10 unto the support spindle 20, the 15 elastomeric segment 92 will hold each of the segments 90*a* into the groove 60 of the spindle 20. Thus, the function of the alternate embodiment of FIGS. 5 and 6 is the same as the embodiment of FIGS. 1–4**.

Although the invention has been described in detail, it is to be clearly understood that the same is by way of illustration and example only and is not to be taken by way of limitation, the spirit and scope of the invention being limited only to the terms of the appended claims.

I claim:

1. A rotary drill bit locking mechanism comprising:

a cutter cone having a bearing surface, a support spindle having a bearing surface, said support spindle having a tapered leading thrust surface edge wherein said tapered thrust surface edge aids in the mating of the cutter cone with the spindle, a first annular groove formed in the bearing surface of said support spindle, a second annular groove formed in the bearing surface of said cutter cone, wherein said first and second annular grooves are radially adjacent to each other when said cutter cone is secured on to said support spindle, a holding ring having a plurality of segments forming a ring-like configuration and assembled to partially extend into said first annular groove and to partially extend into said second annular groove to secure said cutter cone into a rotatable position of said support spindle, and an O-ring of an elastomeric material positioned in said first annular groove between said support spindle and said holding ring for biasing said segments of said holding ring into the ring-like configuration of said first and second annular grooves.

2. The locking mechanism of claim 2 wherein the depth of said first and second annular grooves enables said holding ring and said O-ring to rotate with said cutter cone when supported on said support spindle.

3. The locking mechanism of claim 1 wherein said holding ring comprises three arc shaped segments dimensioned to substantially encircle said first and second annular grooves.

4. A rotary drill bit locking mechanism comprising:

a support spindle having a bearing surface, said support spindle having a tapered leading thrust surface edge, a cutter cone having a bearing surface, a first annular groove formed in the bearing surface of said support spindle, a second annular groove formed in the bearing surface of said cutter cone, wherein said first and second annular grooves are radially adjacent to each other when said cutter cone is secured on to said support spindle, a holding ring having a plurality of segments forming a ring-like configuration and assembled to partially extend into said first annular groove and to partially extend into said second annular groove to secure said cutter cone into a rotatable position on said support spindle, each segment of said holding ring having one tapered surface edge to engage said tapered leading thrust surface edge of said support spindle wherein said matching tapered edge of said holding ring segment and support spindle enable the edges to slide past one another during mating of said cutter cone onto said support spindle, and a ring of elastomeric material for biasing said segments of said holding ring into the ring-like configuration of said first and second annular grooves.

5. The locking mechanism of claim 4, wherein said means for biasing comprises an O-ring of an elastomeric material positioned in said second annular groove between said cutter cone and said holding ring.

6. The locking mechanism of claim 4 wherein said holding ring comprises three arc shaped segments dimensioned to substantially encircle said first and second annular grooves.

7. The locking mechanism of claim 6 wherein said holding ring is made of a beryllium copper material.

8. The locking mechanism of claim 4 wherein said means for biasing is an O-ring of an elastomeric material positioned in said first annular groove between said support spindle and said holding ring.

* * * * *

UNITED STATES PATENT AND TRADEMARK OFFICE

CERTIFICATE OF CORRECTION

PATENT NO. : 4,880,068

DATED : November 14, 1989

INVENTOR(S) : Charles L. Bronson

It is certified that error appears in the above-identified patent and that said Letters Patent is hereby corrected as shown below:

Abstract, line 11, insert "a" after "there is".
Column 4, line 34, delete "15".
Column 5, line 1, delete "2" and insert --1--.

Signed and Sealed this

Twenty-fifth Day of December, 1990

*Attest:*

HARRY F. MANBECK, JR.

*Attesting Officer*

*Commissioner of Patents and Trademarks*